US007237580B2

(12) United States Patent
Hupp et al.

(10) Patent No.: US 7,237,580 B2
(45) Date of Patent: Jul. 3, 2007

(54) CONTAINER GUIDE FOR A CONTAINER FILLING APPARATUS

(75) Inventors: Evan Hupp, Ely, IA (US); Erick W. Kerkman, Cedar Rapids, IA (US); Lyle Knutson, Cedar Rapids, IA (US)

(73) Assignee: Evergreen Packaging Inc., Memphis, TN (US)

( * ) Notice: Subject to any disclaimer, the term of this patent is extended or adjusted under 35 U.S.C. 154(b) by 66 days.

(21) Appl. No.: 11/059,233

(22) Filed: Feb. 16, 2005

(65) Prior Publication Data

US 2006/0179797 A1 Aug. 17, 2006

(51) Int. Cl.
*B65B 1/04* (2006.01)

(52) U.S. Cl. ..... 141/144; 141/372

(58) Field of Classification Search ..... 141/129, 141/144, 267, 268, 270, 369, 372
See application file for complete search history.

(56) References Cited

U.S. PATENT DOCUMENTS

| | | | | |
|---|---|---|---|---|
| D25,203 | S | 2/1896 | Bowen | |
| 3,108,682 | A | 10/1963 | Zipper | |
| 3,670,863 | A | 6/1972 | Meier, et al. | |
| 4,053,003 | A * | 10/1977 | Ferrero et al. | 141/144 |
| 4,393,747 | A | 7/1983 | Gustavsson et al. | |
| 4,721,200 | A | 1/1988 | Dugan | |
| 4,961,446 | A * | 10/1990 | Berg et al. | 141/144 |
| 5,097,942 | A | 3/1992 | Codde | |
| 5,337,796 | A * | 8/1994 | Ohmori et al. | 141/168 |
| 5,490,591 | A | 2/1996 | Faulkner | |
| 5,613,593 | A | 3/1997 | Gerber | |
| 6,321,904 | B1 | 11/2001 | Mitchell | |
| 6,546,973 | B2 | 4/2003 | Hattori et al. | |
| 2004/0128956 | A1 | 7/2004 | Peronek | |

* cited by examiner

*Primary Examiner*—Steven O. Douglas
(74) *Attorney, Agent, or Firm*—Daniel F. Nesbitt; Hasse & Nesbitt LLC

(57) ABSTRACT

A container filling apparatus includes a fill turret configured to carry a plurality of containers along a first portion of a path as the containers are filled with liquid. A container guide is mounted in fixed relation to the fill turret, the container guide defining an upper guide surface and a lower guide surface spaced apart from the upper guide surface. The upper and lower guide surfaces cooperate to define an edge of a second portion of the path, where the upper guide surface is located to contact a container at a first location and the lower guide surface is located to contact the container at a second location that is spaced apart from the first location. The upper and lower guide surfaces maintain the container in an upright position as the container moves along the edge of the path.

20 Claims, 6 Drawing Sheets

CONTAINER GUIDE FOR A CONTAINER FILLING APPARATUS

TECHNICAL FIELD

The present application relates to container filling apparatus and more particularly to a container guide for use with a container filling apparatus.

BACKGROUND

Products, such as liquids, are frequently transported and/or sold in containers. Often times, these containers are formed to be convenient for consumer handling and attractive for display.

Containers, including flexible containers, are frequently filled using automated processes. Such processes can sometimes operate at relatively high speeds in order to increase productivity and production speed. Additionally, automated processes frequently require the containers to change direction. Due to these relatively high speeds and direction changes, product sometimes spills from open tops of the containers after filling the containers and prior to sealing the containers with a lid. This spillage can be caused, for example, by a sudden direction change, or by deflection of the containers' flexible walls. In some cases, spilled product may remain on the containers' outer surfaces even after the containers are placed on display for sale, which may cause customer dissatisfaction with the product. Container guides formed from various fixtures, rails and brackets are frequently employed to aid in guiding containers during filling processes.

SUMMARY

In an aspect, for a container filling apparatus including a fill turret, a container guide for use in guiding containers along a path from the fill turret is provided. The container guide includes an upper guide member defining an upper guide surface and a lower guide member defining a lower guide surface that is spaced apart from the upper guide surface. The upper and lower guide surfaces are configured to cooperate to define an arcuate edge of the path where the upper guide surface is spaced apart from and substantially parallel to the lower guide surface. The upper guide surface is located to contact a container at a first location and the lower guide surface is located to contact the container at a second location that is spaced apart from the first location. The upper and lower guide surfaces are capable of maintaining the container in an upright position as the container moves along the edge of the path.

In another aspect, a container filling apparatus includes a fill turret configured to carry a plurality of containers along a first portion of a path as the containers are filled with liquid. A container guide is mounted in fixed relation to the fill turret, the container guide defining an upper guide surface and a lower guide surface spaced apart from the upper guide surface. The upper and lower guide surfaces cooperate to define an edge of a second portion of the path, where the upper guide surface is located to contact a container at a first location and the lower guide surface is located to contact the container at a second location that is spaced apart from the first location. The upper and lower guide surfaces maintain the container in an upright position as the container moves along the edge of the path.

In another aspect, a method of guiding a container during a filling operation is provided. The method includes forming a container guide including an upper guide member having an upper guide surface and a lower guide member having a lower guide surface. The upper and lower guide surfaces are spaced apart from each other. The container guide is mounted in fixed relation to a fill turret that is configured to carry containers along a first portion of a fill path. The upper and lower surfaces cooperate to define an edge of a second portion of the fill path leading from the first portion of the fill path toward a container outfeed.

The details of one or more embodiments are set forth in the accompanying drawings and the description below. Other features, objects, and advantages will be apparent from the description and drawings, and from the claims.

DETAILED DESCRIPTION

Figure 1:
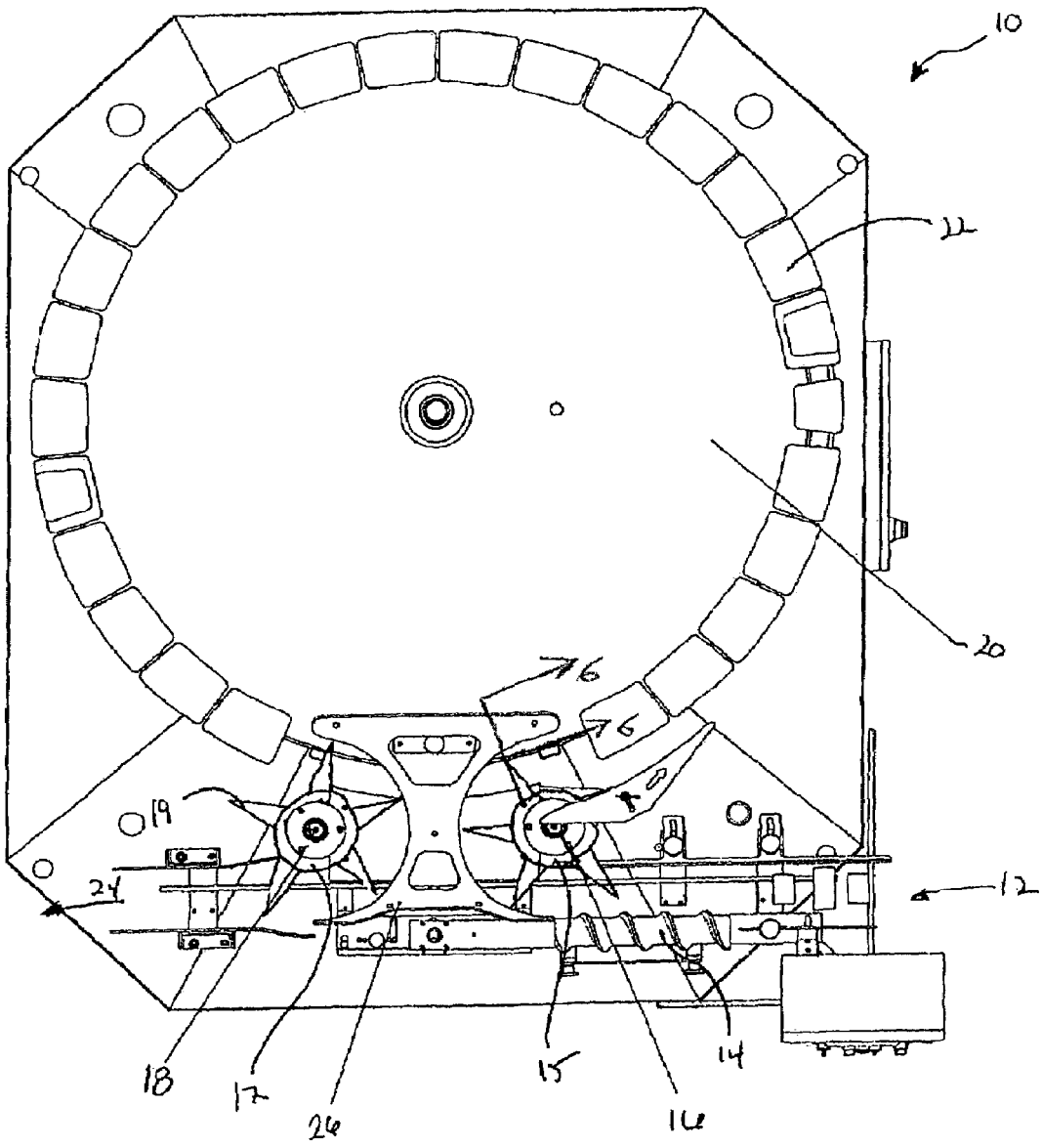
FIG. 1 is a top, partial view of an embodiment of a filling apparatus including an embodiment of a container guide.

Referring to FIG. 1, a filling apparatus 10 includes an infeed 12, a separator 14 for separating containers from each other as the containers travel along a fill path from the infeed, infeed and outfeed star wheels 15, 17 each having an array of paddles 19 for manipulating the containers and associated star wheel drives 16, 18 for rotating the star wheels 15, 17, and a rotatable fill turret 20 with a plurality of carriers 22 disposed about the periphery of the fill turret for use in moving the containers along the fill path toward an outfeed 24. A container guide 26 is fixedly mounted to the apparatus 10. As will be described in greater detail below, the container guide 26 is used for guiding the containers in an upright, standing position onto the carriers 22 of the fill turret 20 prior to filling the containers and for guiding the filled containers off of the carriers 22 of the fill turret 20 in an upright, standing position while minimizing or, in some cases, even eliminating spillage from an open top of the containers as the filled containers are transported from the carriers 22 along the fill path.

Figure 4:
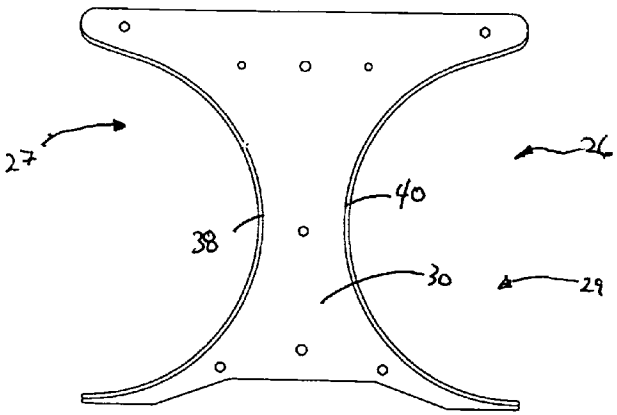
FIG. 4 is a bottom view of the container guide of FIG. 1.
Figure 2:
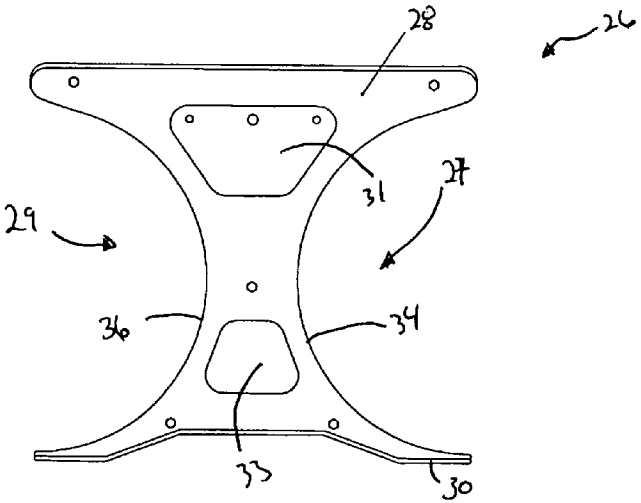
FIG. 2 is a top view of the container guide of FIG. 1.
Figure 3:
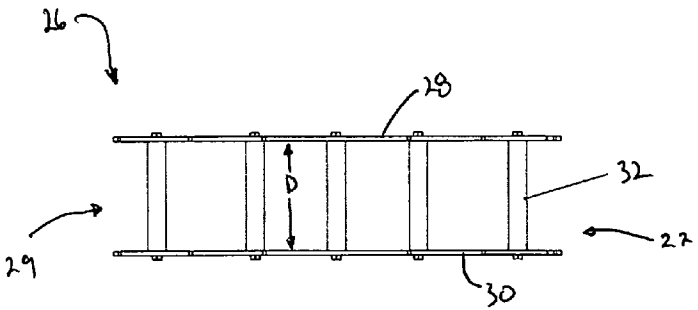
FIG. 3 is an end view of the container guide of FIG. 1.

Referring now to FIGS. 2-4, the container guide 26 has an infeed side 27, an outfeed side 29 and includes an upper guide member 28, a lower guide member 30 and spacers 32 extending between the upper and lower guide members 28, 30. In the illustrated embodiment, the upper and lower guide members 28, 30 are relatively planar, parallel plates including respective guide surfaces 34, 36 and 38, 40 that can contact the containers at spaced-apart locations as they move along the fill path toward and away from the fill turret 20. Surfaces 34, 38 and 36, 40 are also substantially parallel to each other, although the container guide 26 may have non-parallel guide surfaces 34, 36, 38, 40 and/or non-parallel guide members 28, 30. Referring particularly to FIG. 2, the upper guide member 28 includes openings 31 and 33 extending through the upper guide member 28. The openings 31 and 33 reduce the weight of the container guide 26 and can be used to grasp the container guide 26 or at least the upper guide member 28, for example, for transport or disassembly of the container guide 26.

As can be seen by FIG. 3, the upper guide member 28 including guide surfaces 34 and 36 is spaced a predetermined distance D from the lower guide member 30 including guide surfaces 38 and 40. In some embodiments, D is from about one inch (about 2.54 cm) to about eight inches (about 20 cm), such as from about five inches (about 13 cm) to about six inches (about 15 cm). As will be described below, the distance between the upper and lower guide members 28 and 30 may depend, at least in part, on the size and/or contour of the container being transferred to and from the fill turret 20. Thus, D may be increased or decreased depending on the desired use. The spacers 32 may be of fixed dimension or adjustable to allow for adjustment of D without disconnecting the upper and lower guide members 28, 30 from each other. While D is shown as being substantially identical at both infeed and outfeed sides 27 and 29, D can vary from one side to the opposite side.

Figure 5:
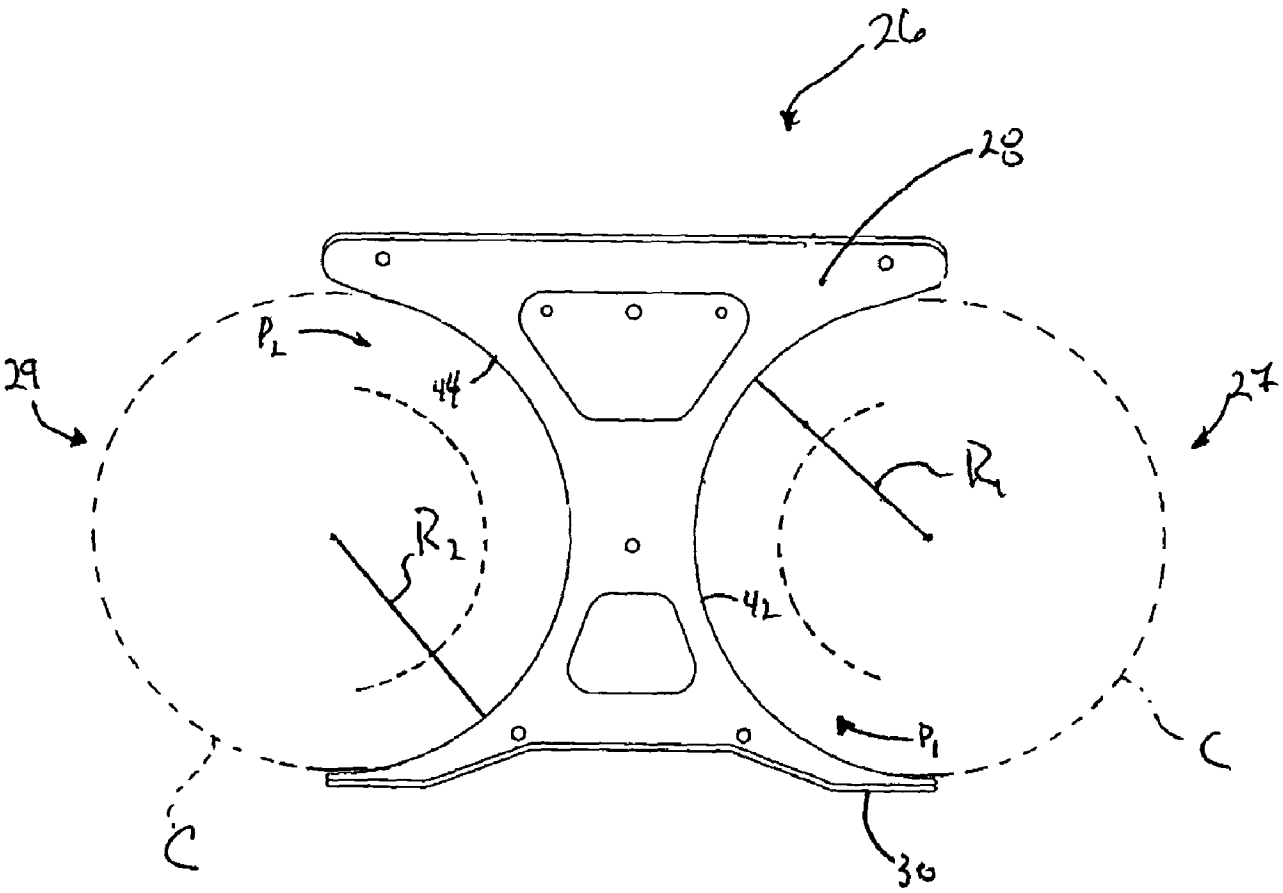
FIG. 5 is a top view of the container guide of FIG. 1 along with a diagrammatic illustration of portions of a fill path.

Referring now to FIG. 5, the guide surfaces 34, 36, 38 and 40 are carefully machined (e.g., by computer-aided laser cutting) to define edges 42 and 44 of portions $P_1$ and $P_2$ of the desired fill path leading to and from the fill turret 20 (FIG. 1). As shown, the edges 42 and 44 of the fill path are arcuate, forming a portion of respective circles C (shown in dashed lines) having radiuses $R_1$ and $R_2$.

$R_1$ and $R_2$ and the circumferential distance of $P_1$ and $P_2$ are selected to alter the trajectory of the containers by between about 90 degrees and 180 degrees from the incoming trajectory (i.e., the approach angle of the containers as they come into contact with the container guide 26). $R_1$ and $R_2$ are also selected to provide a smooth change of direction as the container travels along $P_1$ and $P_2$, to maintain the containers in an upright, standing position as the trajectory of the containers are being altered, and to minimize or even eliminate deflection of a container's outer wall (in cases where a flexible container is being filled, such as a plastic milk container), which can, in turn, minimize or even eliminate product, such as liquid, spillage, e.g., due to tangential acceleration, deceleration and/or sidewall deflection, sometimes referred to as "oil canning". As a first example, $R_1$ and $R_2$ may be about 11 inches (about 28 cm) for guiding a gallon-sized, plastic milk-type container. As another example, $R_1$ and $R_2$ may be about 10 inches (about 25 cm) for guiding a one-half gallon-sized, plastic milk-type container. In some embodiments, $R_1$ and $R_2$ may be of differing lengths.

Figure 6:
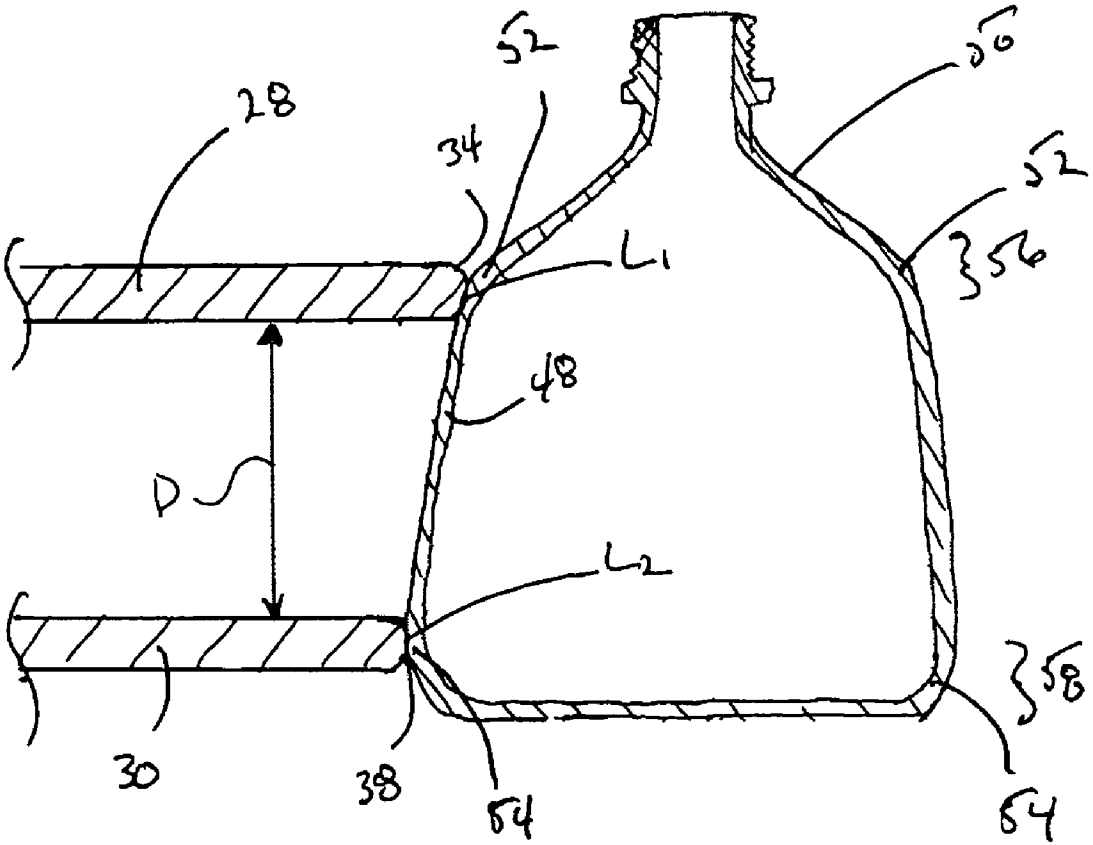
FIG. 6 is a section view of the container guide of FIG. 1 taken through line 6-6 showing the container guide in contact with a flexible container.

Referring now to FIG. 6, the first upper guide surface 34 of upper guide member 28 is shown extending outwardly a first distance toward, and into, the respective portion of the fill path, while the first lower guide surface 38 of lower guide member 30 is shown extending outwardly a second distance toward, and to, the fill path. As shown in FIG. 6, the second distance is less than the first distance. As noted above, the upper and lower guide members 28 and 30 are spaced apart from each other a distance D. By providing this spacing between the upper and lower guide members 28, 30, guide surfaces 34 and 38 (and also guide surfaces 36 and 40) may contact a flexible (e.g., plastic) wall 48 of a flexible container 50 at pre-selected locations $L_1$ and $L_2$, while maintaining the container 50 in an upright, standing position as the trajectory of the container 50 travels along the fill path. As shown, $L_1$ and $L_2$ correspond to sections 52 and 54 of the flexible container 50 having higher rigidity due to the contour of the 50 container at sections 52 and 54. In the illustrated embodiment, higher strength sections 52, 54 are located at upper and lower curved portions 56 and 58. By contacting the flexible container 50 at higher strength sections 52 and 54, the probability that the flexible wall 48 may deflect inwardly due to contact with the upper and lower guide members 28 and 30 may be reduced.

Referring still to FIG. 6, to minimize wear on the container 50 due to sliding contact between wall 48 of the container and guide surfaces 34, 36, 38 and 40, the guide surfaces 34, 36, 38, 40 are radiused to eliminate relatively sharp corners from contacting the container 50. Alternatively, one or more of the guide surfaces 34, 36, 38, 40 may not be radiused. In some embodiments, the guide surfaces 34, 36, 38, 40 may be finished (e.g., by polishing, such as by electro polishing), for example, to a root mean square (RMS) average surface finish of between about 32 and about 63 micro-inches. In some cases, the guide surfaces 34, 36, 38, 40 may be coated with a material, such as a ceramic coating or specialized paint that can reduce the coefficient of friction of the guide surfaces.

The width of the guide surfaces 34, 36, 38, 40 may also be selected as desired. In some embodiments, the thicknesses of the guide members 28, 30 and their associated guide surfaces 34, 36, 38, 40 are relatively thin, e.g., between about 0.1 inch and about one inch, such as about 0.19 inch and/or 0.25 inch, to expose relatively little area to the wall 48 of the container 50 as the container 50 slides along the guide surfaces 34, 36, 38, 40.

Suitable methods for forming the upper and lower members 28 and 30 including guide surfaces 34, 36, 38 and 40 include, for example, laser cutting. Laser cutting can provide the desired fill path contour within tolerances, in some embodiments, of about 0.015 inch or less. Other suitable methods for forming the upper and lower members include bending in cases where the contour of the guide surfaces can be accurately held, and/or machining. Suitable materials for forming the upper and lower guide members 28, 30 include metals, such as steel and steel alloys including stainless steel. In some embodiments, the container guide 26 is assembled and the upper and lower members are aligned using, e.g., fasteners, counterbore/pilot arrangements and/or dowel pins. Other suitable methods may include welding.

Figure 7:
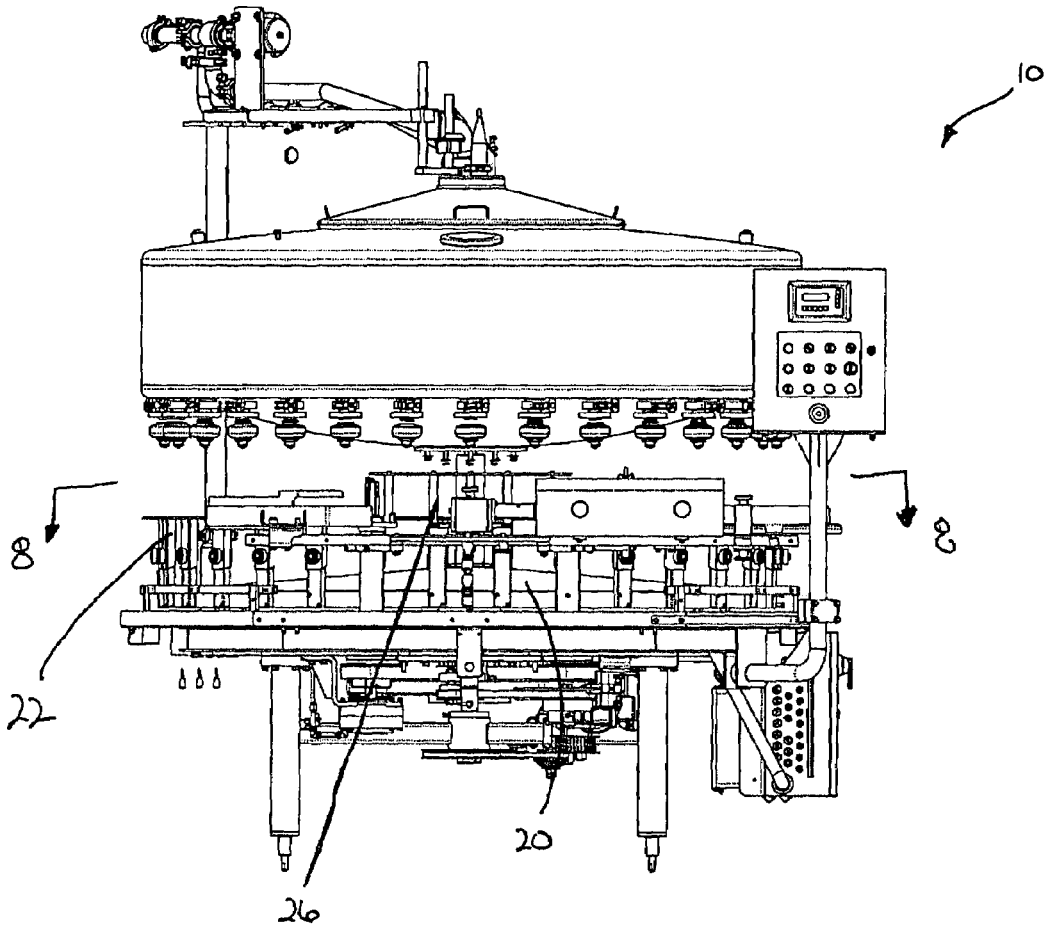
FIG. 7 is a front view of the filling apparatus of FIG. 1.
Figure 8:
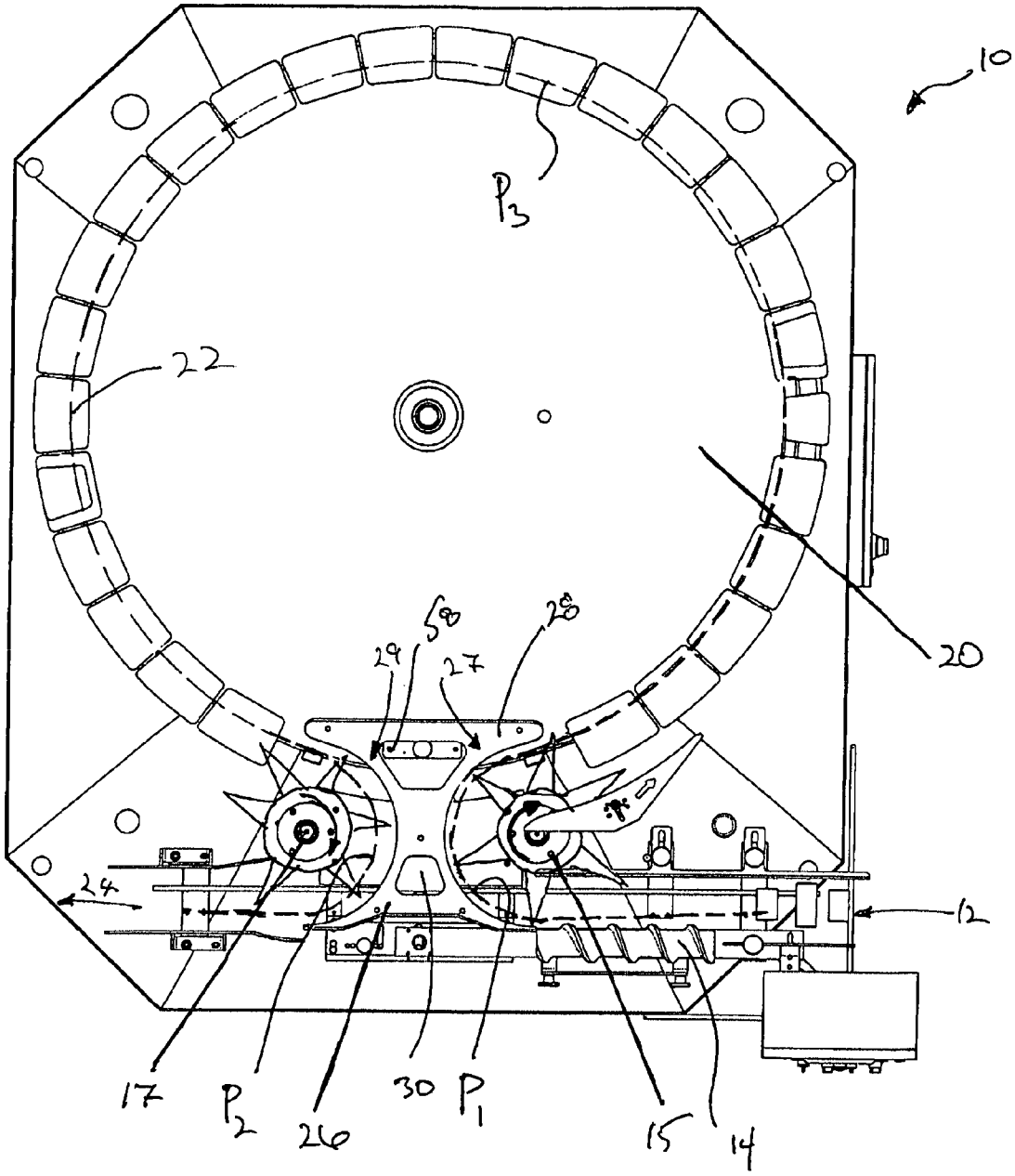
FIG. 8 is a top, partial view of the filling apparatus along lines 8-8 of FIG. 7.

Referring now to FIGS. 7 and 8, the container guide 26 is fixedly mounted to filling apparatus 10 such that the turret 20 rotates relative to the stationary container guide. As most clearly shown by FIG. 8, the infeed and outfeed sides 27 and 29 of the container guide 26 are aligned such that $P_1$ and $P_2$ are aligned with the portion $P_3$ of the fill path about the fill turret 20. Dowel pins and fasteners (see element 58) can be used to mount the container guide 26 to the filling apparatus 10. Other attachment methods can be used, such as welding the lower guide member 30 to the filling apparatus 10.

As noted above, the container guide 26 is suitable for use with flexible containers, such as, for example, those suitable for containing water, milk, juice, distilled spirits, wine or any other substance that may be packaged in either a liquid or a non-liquid state, e.g., jelly, powder, numerous components such as fasteners, etc. In some embodiments, the container guide 26 may be used with rigid-walled containers.

A number of detailed embodiments have been described. Nevertheless, it will be understood that various modifications may be made. For example, in some embodiments, the guide surfaces of the upper and lower members may alter the trajectory of the containers by an angle greater than 180 degrees or less than 90 degrees from the incoming trajectory. In other embodiments, the container guide may include only an outfeed side 29 capable of guiding a container from the fill turret as described above, only an infeed side 27 capable of guiding a container to the fill turret, or in some cases, multiple container guides may be used, e.g., where one container guide includes only an infeed side 27 capable of guiding a container to the fill turret as described above and another container guide includes only an outfeed side 29 capable of guiding a container from the fill turret as described above. Accordingly, other embodiments are within the scope of the following claims.

What is claimed is:

1. For a container filling apparatus including a fill turret, a container guide for use in guiding containers along a first path from the fill turret, the container guide comprising:

an upper guide member defining a first upper guide surface; and a lower guide member defining a first lower guide surface that is spaced apart from and substantially parallel to the first upper guide surface;

wherein the first upper and first lower guide surfaces are configured to cooperate to define an arcuate edge of the first path, wherein the first upper guide surface extends outwardly a first distance toward the first path to contact a container disposed in the first path at a first location of the container, and wherein the first lower guide surface extends outwardly a second distance toward the first path to contact the container at a second location of the container that is spaced apart from the first location, the second distance being less than the first distance, whereby the first upper and first lower guide surfaces are capable of maintaining the container in an upright position as the container moves along the edge of the first path.

2. The container guide of claim 1, wherein the upper and lower guide members each comprise a plate.

3. The container guide of claim 1, wherein the upper guide member further defines a second upper guide surface and the lower guide member further defines a second lower guide surface, wherein, the second upper guide surface and the second lower guide surface cooperate to define a second, arcuate edge of a second path leading to the fill turret, wherein the second upper guide surface extends outwardly the second distance toward the second path to contact the container at a third location on the container and the second lower guide surface extends outwardly the second distance toward the second path to contact the container at a fourth location on the container that is spaced apart from the third location, the second upper and second lower guide surfaces being capable of maintaining the container in an upright position as the container moves along the edge of the second path leading to the fill turret.

4. The container guide of claim 1 further comprising a spacer extending between the upper guide member and the lower guide member.

5. The container guide of claim 1 comprising stainless steel.

6. The container guide of claim 1, wherein the upper and lower guide surfaces are positioned wherein the first and the second locations of the container are high strength locations of the container.

7. A container filling apparatus comprising:

a fill turret configured to carry a plurality of containers along a first portion of a fill path as the plurality of containers are filled with liquid; and a container guide mounted in fixed relation to the fill turret, the container guide having a first upper guide surface and a first lower guide surface spaced apart from the first upper guide surface;

wherein the first upper and first lower guide surfaces cooperate to define an edge of a second portion of the fill path, wherein the first upper guide surface extends outwardly a first distance toward the second portion of the fill path to contact the plurality of containers at a first location of the container, and the first lower guide surface extends outwardly a second distance toward the second portion of the fill path to contact the plurality of containers at a second location of the container that is spaced apart from the first location, the second distance being less than the first distance, whereby the first upper and first lower guide surfaces maintain the plurality of containers in an upright position as the plurality of containers move along the edge of the second portion of the fill path.

8. The container filling apparatus of claim 7, wherein the first portion of the fill path merges with the second portion of the fill path.

9. The container filling apparatus of claim 7, wherein the container guide further has a second upper guide surface and a second lower guide surface, wherein the second upper and second lower guide surfaces cooperate to define an edge of a third portion of the fill path, the second upper guide surface extends outwardly a first distance toward the third portion of the fill path to contact the plurality of containers at a third location of the container, and the second lower guide surface extends outwardly a first distance toward the third portion of the fill path to contact the plurality of containers at a fourth location of the container that is spaced apart from the third location, whereby the second upper and second lower guide surfaces maintain the plurality of containers in an upright position as the plurality of containers move along the edge of the third portion of the fill path.

10. The container filling apparatus of claim 9, wherein the third portion of the fill path merges with the first portion of the fill path.

11. The container filling apparatus of claim 7, wherein the edge of the second portion of the fill path defined by the first upper and first lower guide surfaces is arcuate.

12. The container filling apparatus of claim 11 further comprising a container drive wheel, the drive wheel configured to move the plurality of containers along the edge of the second portion of the fill path.

13. The container filling apparatus of claim 7, wherein the container guide comprises an upper guide plate defining the first upper guide surface, a lower guide plate defining the first lower guide surface, and a spacer extending between the upper and lower guide plates.

14. The container filling apparatus of claim 7, wherein the first upper and first lower guide surfaces are positioned wherein the first and the second locations of the container are high strength locations of the container.

15. A method of guiding a container during a filling operation, the method comprising:

a) forming a container guide comprising an upper guide member having a first upper guide surface that extends outwardly a first distance, and a lower guide member having a first lower guide surface that extends outwardly a second distance, the first upper and first lower guide surfaces being spaced apart from each other, and the second distance being less than the first distance;

b) mounting the container guide in fixed relation to a fill turret configured to carry containers along a first portion of a fill path, the first upper and first lower guide surfaces cooperating to define an edge of a second portion of the fill path leading from the first portion of the fill path toward a container outfeed; and c) moving a container along the edge of the second portion of the fill path, comprising i) contacting a first location on the container with the first upper guide surface, and ii) contacting a second location on the container, spaced from the first location, with the first lower guide surface, whereby the first upper and first lower guide surfaces cooperate to maintain the container in an upright position as the container moves along the edge of the second portion of the fill path.

16. The method of claim 15, wherein the upper guide member has a second upper guide surface that extends outwardly a first distance, and the lower guide member has a second lower guide surface that extends outwardly a second distance, the second lower guide surface being spaced apart from the second upper guide surface, the second upper guide surface and the second lower guide surface cooperating to define a second edge of a third portion of the fill path leading to the first portion of the fill path, and further comprising the step of:

d) moving the container along the edge of the third portion of the fill path, said moving comprising:

i) contacting the first location on the container with the second upper guide surface, and ii) contacting the second location on the container with the second lower guide surface, whereby the second upper and second lower guide surfaces are capable of maintaining the container in an upright position as the container moves along the edge of the third portion of the fill path.

17. The method of claim 15 further comprising altering a trajectory of a container from an approach trajectory using the container guide.

18. The method of claim 15, wherein the step of forming the container guide includes spacing the upper guide member from the lower guide member using a spacer.

19. The container filling apparatus of claim 9, wherein the container guide comprises an upper guide plate that defines the first and second upper guide surfaces, a lower guide plate that defines the first and second lower guide surfaces, and a spacer extending between the upper guide plate and lower guide plates.

20. The method of claim 15, wherein the upper guide member comprises an upper guide plate, and the lower guide member comprises a lower guide plate.

* * * * *